US007076069B2

(12) United States Patent
Roeck

(10) Patent No.: US 7,076,069 B2
(45) Date of Patent: Jul. 11, 2006

(54) METHOD OF GENERATING AN ELECTRICAL OUTPUT SIGNAL AND ACOUSTICAL/ELECTRICAL CONVERSION SYSTEM

(75) Inventor: Hans-Ueli Roeck, Hombrechtikon (CH)

(73) Assignee: Phonak AG, Stafa (CH)

( * ) Notice: Subject to any disclaimer, the term of this patent is extended or adjusted under 35 U.S.C. 154(b) by 1317 days.

(21) Appl. No.: 09/864,768

(22) Filed: May 23, 2001

(65) Prior Publication Data

US 2002/0176587 A1 Nov. 28, 2002

(51) Int. Cl.
*H04R 3/00* (2006.01)

(52) U.S. Cl. ..... 381/92; 381/91; 381/122; 381/313; 381/321

(58) Field of Classification Search ..... 381/91, 381/92, 122, 111, 112, 113, 58, 356, 313, 381/320, 321, 102; 367/124
See application file for complete search history.

(56) References Cited

U.S. PATENT DOCUMENTS 5,483,599 A * 1/1996 Zagorski ..... 381/327
5,978,490 A * 11/1999 Choi et al. ..... 381/92
6,137,887 A * 10/2000 Anderson ..... 381/92
6,385,323 B1 * 5/2002 Zoels ..... 381/313
6,549,630 B1 * 4/2003 Bobisuthi ..... 381/94.7
6,603,861 B1 * 8/2003 Maisano et al. ..... 381/92
6,741,714 B1 * 5/2004 Jensen ..... 381/313
6,766,029 B1 * 7/2004 Maisano ..... 381/313
6,865,275 B1 * 3/2005 Roeck ..... 381/92
6,950,528 B1 * 9/2005 Fischer ..... 381/92
2004/0057593 A1 * 3/2004 Pedersen et al. ..... 381/321

FOREIGN PATENT DOCUMENTS

EP 0 982 971 A 3/2000
WO 99 45741 A 9/1999
WO 01 10169 A 2/2001

* cited by examiner

*Primary Examiner*—Xu Mei
(74) *Attorney, Agent, or Firm*—Pearne & Gordon LLP

(57) ABSTRACT

At a beamformer with at least two acoustical/electrical converters ($M_1$, $M_2$) the outputs ($A_1$, $A_2$) thereof are operationally connected to a beamformer unit (12). There signals dependent on signals ($S_1$, $S_2$) arising at said outputs ($A_1$, $A_2$) are co-processed to result in a beamformer output signal ($S_a$) dependent on both output signals of the converters. Frequency roll-off of the output signal ($S_a$) is counteracted by establishing a gain mismatch (10) of the two gains between the acoustical input signal (A) on one hand and the inputs to unit 12.

24 Claims, 8 Drawing Sheets

METHOD OF GENERATING AN ELECTRICAL OUTPUT SIGNAL AND ACOUSTICAL/ELECTRICAL CONVERSION SYSTEM

The present invention is directed, generically, on the art of beamforming. Although it is most suited to be applied for hearing apparatus, and thereby especially hearing aid apparatus, it may be applied to all categories of beamforming with respect to acoustical/electrical signal conversion. We understand under beamforming of acoustical to electrical conversion tailoring the dependency of the transfer gain of an acoustical input signal to an electrical output signal from the spatial angle at which the acoustical signal impinges on acoustical/electrical converters, and, in context with the present invention, on at least two such acoustical to electrical converters.

In some types of such beamforming as especially based on the so-called "delay and sum" approach, the dependency of the output signal from the spatial angle of the impinging acoustical signal is additionally dependent on frequency of the acoustical signal.

Although we are going to explain this phenomenon on the basis of the so-called "delay and sum" beamformer, which is most suited for implementing the present invention, other types of beamformers may show up frequency-dependent beamforming as well and thus might be suited for implementing the present invention too.

In FIG. 1 there is schematically shown, by means of a signal flow/functional block diagram, a so-called "delay and sum" beamformer. There is provided an acoustical electrical converter arrangement 1 with at least two acoustical/electrical converters, as of microphones $M_1$ and $M_2$. These at least two acoustical/electrical converters $M_1$ and $M_2$ are arranged with a predetermined mutual distance p. Considering an acoustical signal A impinging on the two acoustical/electrical converters $M_1$, $M_2$ and generated from an acoustical source considerable further away than given by the distance p, there occurs a difference d of path length for the acoustical signal A with respect to $M_1$ and $M_2$. Dependent on the spatial angle θ, at which the acoustical signal A impinges on the converters, d results to $$d=p\cdot\cos\theta$$

This accords to a phase shift $\Delta\phi_p$ or to a time-delay $\tau_p$ which may be expressed as $$\tau=\frac{d}{c}=\frac{p}{c}\cdot\cos\theta,$$

Therein, c is the velocity of sound in surrounding air. The output signals $S_1$ and $S_2$ have thus a mutual phasing $\Delta\phi_p$ according to the impinging angle θ. The two signals $S_1$ and $S_2$ are superimposed by addition as shown by the adding unit 5 of FIG. 1 after of one of the two signals having been delayed by τ' as shown at the unit 7. By appropriate selection of τ' there is established, for which spatial angle θ the gain between acoustical input A and result of the addition, $S_a$, will be maximum and, respectively, minimum. If the two converters $M_1$ and $M_2$ are e.g. omnidirectional this will result in a first order beamforming characteristic at the output $S_a$ of the adding unit 5 with respect to acoustical input signal A. Such a characteristic is qualitatively shown in FIG. 2 for one frequency f of an acoustical signal A. With respect to frequency behavior of this characteristic attention is drawn to FIG. 3. Here the frequency dependency of the gain, the so-called "roll-off" characteristic, is shown for a first order beamformer realized e.g. by the embodiment of FIG. 1 with p=1.9 cm, as shown at (a) and for p=1.2 cm as shown at (b). The characteristic (c) will be discussed later in connection with the present invention In dependency of the order of beamforming the beam characteristic has a significant high-pass behavior. At a first order cardioid beam gain drops with 20 dB/Dk, for a second order beam characteristic with 40 dB/Dk, etc. An important drawback of such a transfer gain frequency dependency is the significant reduction of the signal to noise ratio for lower frequency signals. This has a negative impact on the quality of sound conversion, especially in the "target direction", that is in direction θ, wherefrom acoustical signal shall be amplified with maximum gain.

It is an object of the present invention to provide for a method and a respective system, whereat frequency behavior of the beamforming gain characteristic may be adjusted and thereby especially remedied at least over a desired frequency band. To do so, there is proposed a method of generating an electrical output signal as a function of acoustical input signals impinging on at least two acoustical/electrical converters, the gain between the acoustical input signal and the electrical output signal being dependent on the spatial angle with which the acoustical input signals impinge on the at least two converters. Further, the gain is dependent on frequency of the acoustical input signals. Thereby, first and second signals respectively depending on the acoustical input signals are co-processed to result in a third signal which is dependent on both, namely the first and the second signal.

When we refer to "co-processing" signals, we thereby mean performing an operation on both signals resulting in a signal which is dependent on both input signals. Thus, addition, multiplication, division etc. are considered to be co-processing operations, whereat time-delaying a signal or phase-shifting a signal or amplifying are considered non-co-processing operations.

Further and in view of the above mentioned object there is established a desired frequency dependency of the gain by installing a mismatch of gains between the acoustical input signal and the first signal and between the acoustical input signal and the second signal, both first and second signal being then co-processes.

Thereby, the present invention departs from the following recognition:

We have in context with FIG. 3 shown the frequency roll-off of a beamformer, as especially addressed by the present invention having a high-pass characteristic. This is nevertheless only then valid, if the gains between the acoustical input signal and the first signal applied to co-processing as of adding at unit 5 of FIG. 1, and the gain between the acoustical input signal and the second signal as applied to the second input of co-processing are perfectly matched. If these gains are mismatched, which is customarily to be avoided by all means, there results a roll-off behavior as shown in FIG. 2 at (c). The frequency characteristic transits for mismatched gains at a lower edge frequency $f_T$ from high-pass behavior to an all-pass or proportional behavior.

In contrary to previous approaches of beamforming realization, where all measures possible were taken to avoid such mismatch, the present invention advantageously exploits such mismatch.

Although in one embodiment of the present invention such mismatch may be installed in a fixed manner, as e.g. by appropriately selecting mismatched converters, in a preferred embodiment of the inventive method such mismatch is provided adjustable and especially automatically adjusted.

In a most preferred embodiment of realizing the inventive method, mismatch is established in dependency of the spatial impinging angle of the acoustical input signal. Thus, different extents of mismatch are selected for different spatial angles or ranges of spatial angle.

Thereby, in a further preferred Embodiment, a predetermined mismatch is established whenever the spatial angle of the acoustical input signal is within a predetermined range, if it is not, a different mismatch up to no mismatch is established or maintained.

By further establishing the mismatch in dependency of the frequency of the acoustical input signal it becomes possible to tailor the frequency behavior of the gain or beam.

As was mentioned above, in one preferred mode of realizing the inventive method a "delay and sum"-type beamformer is improved. Thus, in a preferred embodiment the inventive method further proposes to time-delay one of the first and of the second signals before co-processing is performed. Thereby, in a further preferred mode such time-delaying is performed in a dependency of frequency of the acoustical input signal.

In a most preferred variant of performing the inventive method time-domain to frequency-domain conversion is performed at the first and at second electrical signals, which are dependent on the impinging acoustical signal, before co-processing is performed. As will be seen from the following explanations, signal processing in frequency-domain is most advantageous. Thereby, for subsequent time frames according to the conversion clock and for at least a part of the frequencies of the conversion, of the bins, there is generated a complex mismatch control signal, i.e. with real and imaginary components. By adjusting mutual phasing of the first and second signals and simultaneously performing said mismatch by the complex mismatch control signal, on one hand time-delaying is realized frequency-specifically, and mismatch is realized frequency-selectively too. After such complex mismatch control with a complex value the mismatched signals may just be additively co-processed to realize an inventively improved "delay and sum" beamformer.

In a further improved mode of operation of the just mentioned mismatching by means of a complex mismatch control signal, there is proposed to calculate the actual mismatch control signal by means of an approximation algorithm. Thereby, the actual mismatch control signal for instantaneous time frame of time-domain to frequency-domain conversion is evaluated on the basis of such mismatch control signal as was derived for a previous time frame, preferably the next previous time frame. Optimal results are achieved with minimal resources of computing power by applying a "least means square" algorithm.

The above mentioned object is further resolved with an acoustical/electrical conversion system of the present invention, which comprises at least two acoustical to electrical converters respectively with first and second outputs. These outputs are operationally connected to inputs of a co-processing unit which generates an output signal dependent on signals on both, said first and said second outputs. The output of the co-processing unit is operationally connected to an output of the system, whereat a signal is generated, which is dependent on an acoustical signal impinging on the at least two converters and from spatial angle with which the acoustical signal impinges on these converters. Further, this angle dependency is dependent on frequency of the acoustical signals. Thereby the gains between acoustical input to said converters and the inputs to the co-processing unit are wantedly mismatched to provide for a desired dependency of the signal generated at the system output on the frequency of the acoustical input signals.

Preferred embodiments of the system according to the present invention, whereat the inventive method is realized, are specified in claims 14 to 24.

The invention shall now be exemplified by means of the following detailed description and with the help of figures. These show:

FIGS. 1 to 3 have already been explained

FIG. 4 in a signal flow/functional block simplified representation, the generic principle of the inventive method and system;

FIG. 5 in a representation in analogy to that of FIG. 4, a first preferred realization form of the inventive method and system;

FIG. 6 in a representation form according to that of the FIGS. 4 and 5, a further improvement of the system and method by applying complex mismatch control and thereby simultaneously realizing delaying of a delay and sun beamformer and controlled mismatching;

FIG. 7 again in a representation in analogy to that of the FIGS. 4 to 6, a preferred realization form of the embodiment according to FIG. 6, FIG. 8 still in the same representation, a today's preferred mode of realization of the embodiment according to FIG. 7, thereby using approximation for mismatch control;

FIG. 9 the gain characteristic with respect to spatial angle and frequency of a prior art delay and sum beamformer;

FIG. 10 the beamformer leading to the gain characteristic of FIG. 9, inventively improved, thereby selecting a mismatch spatial angle range of ±90°, and FIG. 11 a characteristic according to that of FIG. 10 for further reduced range of spatial angles, for which the inventively applied mismatch is active.

FIG. 4 shows in a most schematic and simplified manner a signal flow/functional block diagram of a system according to the present invention, thereby operating according to the inventive method. From the array or arrangement 1 of at least two acoustical/electrical converters $M_1$ and $M_2$ and at respective outputs $A_1$ and $A_2$, two electrical signals $S_1$ and $S_2$ are generated.

In processing unit 12 signals $S_{101}$ and $S_{102}$, respectively applied to inputs $E_{121}$ and $E_{122}$ of unit 12, are co-processed, resulting in a signal dependent on both input signals $S_{101}$ and $S_{102}$. These signals input to unit 12 respectively depend on the signals $S_1$ and $S_2$ and are generated at outputs $A_{101}$ and $A_{102}$ of a mismatch unit 10 with inputs $E_1$ and $E_2$, to which the signals $S_1$ and $S_2$ are led.

In the mismatch unit 10 the gains between the acoustical input signal A to respective ones of the signals $S_{101}$ and $S_{102}$ are set. Thereby, as schematically shown by adjusting elements $\mathbf{10}_1$ and $\mathbf{10}_2$ an appropriate desired mismatch of the gains in the two channels from $M_1$ to one input of unit 12 and from $M_2$ to the other input thereof is established. Such a mismatch as schematically shown in FIG. 4 may be installed by appropriately selecting the converters $M_1$ and $M_2$ to be mismatched themselves with respect to their conversion transfer function, but is advantageously provided as shown in FIG. 4 in the respective electrical signal paths. As inventively a mismatch with respect to the two channels is to be installed it is clear that mismatching the gain in only one of the channels is sufficient, although the gain in both channels may be respectively adjusted or selected to result in the desired mismatch by inversely varying the respective channel's gains.

Still simplified and with a signal flow/functional block representation, FIG. 5 shows a preferred realization form of the principal according to the present invention and as explained with the help of FIG. 4. Elements which have already been described in context with FIGS. 1 to 4 are referred to with the same reference numbers.

According to the embodiment of FIG. 5 the mismatch unit 10 most generically shown in FIG. 4 is realized as a mismatch unit 10', interconnected as was explained in the respective channels from the acoustical input of the converters $M_1$, $M_2$ to the respective inputs $E_{121}$, $E_{122}$ of the processing unit 12, where co-processing occurs. By applying a control signal $S_{C10}$ to the control input $C_{10}$ mismatch of these two channels is adjusted. The control input $C_{10}$ is operationally connected to the output $A_{14}$ of a mismatch-controlling unit 14. Inputs $E_{141}$ and $E_{142}$ to the mismatch-controlling unit 14 are operationally connected to the respective outputs $A_1$ and $A_2$ of the converter arrangement 1. Thus, the respective signals $S_{12}$ and $S_{11}$ input to unit 14 are in most generic terms dependent on the output signals $S_1$ and $S_2$. As will be seen later on such an input signal as dependent on $S_1$ and/or $S_2$ may also be derived from the output signal $S_a(S_{101}, S_{102})$ at the output of processing unit 12.

Due to such input signals to the mismatch-controlling unit 14, information about spatial angle θ with which the acoustical signal A impinges on converter arrangement 1 is present, namely e.g. by the information about the mutual phasing $\Delta\phi_p$ of the signals $S_1$, $S_2$. Also when, as shown in dashed lines, one first input of unit 14 receives a signal dependent on only one of the signals $S_1$ and $S_2$ as well as as a second input signal, namely a signal dependent on the output signal $S_a$ of processing unit 12, which per se depends on the second signal $S_1$ or $S_2$ respectively too, spatial angle information is present by these two signals $S_1$ or $S_2$ and $S_a$.

In mismatch-controlling unit 14 the control signal $S_{C10}$ is generated in dependency of the spatial angle θ with which the acoustical signal A impinges on the arrangement 1. Although such dependency may be established in a large variety of different ways to establish, at mismatch unit 10' for selected spatial angles θ desired mismatching of the channel gains in a most preferred embodiment the control signal $\overline{S_{C10}}$ establishes mismatch, whenever the spatial angle θ of the acoustical signal A is within a predetermined range $\theta_R$ of spatial angle.

Thus, according to the embodiment of FIG. 5 mismatch is established in dependency of the spatial angle θ and especially preferred only if the spatial angle θ of the acoustical input signal is within a predetermined range, and thereby especially in a predetermined range symmetrically with respect to that impinging angle, which shall have, according to FIG. 2 at θ=0, maximum amplification.

Looking back on FIG. 3, for a "delay and sum"-type beamformer, applying the teaching of FIG. 5 results in the high-pass characteristic being remedied by mismatch within the range $\theta_R$ of spatial angle with high gain, whereat for spatial angles aside the desired range $\theta_R$ and according to side parts of the beam of FIG. 2 and as denoted there by the areas F, high-pass characteristic is maintained. This leads to an even improved beamforming effect of the "delay and sum" beamformer.

Most schematically there is shown in FIG. 2, for the spatial angle θ=0 and for spatial angles aside the predetermined range $\theta_R$, an example of roll-off/spatial angle distribution, in dotted lines and denoted with "ro".

Departing from the realization form according to FIG. 5, FIG. 6 shows a further improvement. Thereby, the mismatch unit 10' performs for adjusting and mismatching the complex gains of the channels from acoustical input signal A to the respective inputs $E_{121}$ and $E_{122}$ of the co-processing unit 12. Accordingly the mismatch-controlling unit 14' generates a complex controlling signal $\overline{S_{C10}}$ which controls the complex gain mismatch, as exemplified in the block of unit 10' by adjusting complex impedance elements $\overline{Z_{101}}$ and $\overline{Z_{102}}$. By applying a complex gain mismatch and as is evident to the skilled artisan, the magnitude of the respective gains of the channels is mismatched as well as the mutual phasing of the two channels being adjusted, as schematically represented in FIG. 6 by $\Delta\phi_p$ as input phasing to unit 10' and controlled output phasing $\Delta\phi_c$.

As adjusting mutual phasing is equivalent to adjusting a mutual time-delay as of τ' in the delay and sum beamformer of FIG. 1, it just remains in co-processing unit 12 to perform summing to realize a delay and sum beamformer, which is nevertheless improved with respect to frequency roll-off.

The embodiment of FIG. 6, whereat a complex mismatch control is performed and which is highly advantageous, is clearly best realized in frequency-domain.

Accordingly, in the embodiment of FIG. 7 as a most preferred embodiment the result of the acoustical/electrical conversion in the respective channels is first analogue to digital converted at respective converters $\mathbf{16}_1$ and $\mathbf{16}_2$. Subsequently the respective digital signals $S_1$# and $S_2$# are subjected to time-domain to frequency-domain conversion at respective converters $\mathbf{18}_1$ and $\mathbf{18}_2$. The mismatch controlling unit 14' provides for each time frame of the time-domain to frequency-domain conversion and for at least a part of the frequencies or bins a complex mismatch control signal $\overline{S_{C10}}$ fed to the mismatch unit 10', whereat element, by element multiplication is performed of the complex vectorial signal $\overline{S_2}$ with the complex mismatch control signal $\overline{S_{C10}}$, thus multiplying each element of $\overline{S_2}$, e.g. $S_{21}$, $S_{22}$ with the respective element of $S_{C10}$, e.g. $S_{C101}$, $S_{C102}$, leading to the result $S_{102}$ with elements $S_{21} \cdot S_{C101}$, $S_{22} \cdot S_{C102}$.

The today's most preferred realization form of the inventive method and system is shown in FIG. 8. It departs from the embodiment of FIG. 7. Only parts and functions, which have not been described yet will be addressed. The mismatch-controlling unit 14" is fed with one of the time to frequency domain converted output signals $S_1$ or $S_2$, as shown in FIG. 8 with $S_2$ as a complex value signal. The second input according to $E_{141}$ e.g. of FIG. 5 is operationally connected with the output $A_{12}$ of the co-processing unit 12. The mismatch-controlling unit 14" calculates from the output signal of the system prevailing for a previous time frame of time to frequency conversion as well as from an actual signal as of $\overline{S_2}$, of an actual time frame, with an approximation algorithm, most preferably with a "least means square" algorithm, the complex valued mismatch-controlling signal $\overline{S'_{C10}}$, which is element by element multiplied ill the multiplication unit 10' acting as mismatch unit. As was explained summation for the inventive "delay and sum" beamformer as of FIG. 8 is performed in co-processing unit 12, the output signal thereof $\overline{S_a}$ being backtransformed to time-domain in unit 20.

Figure 11:
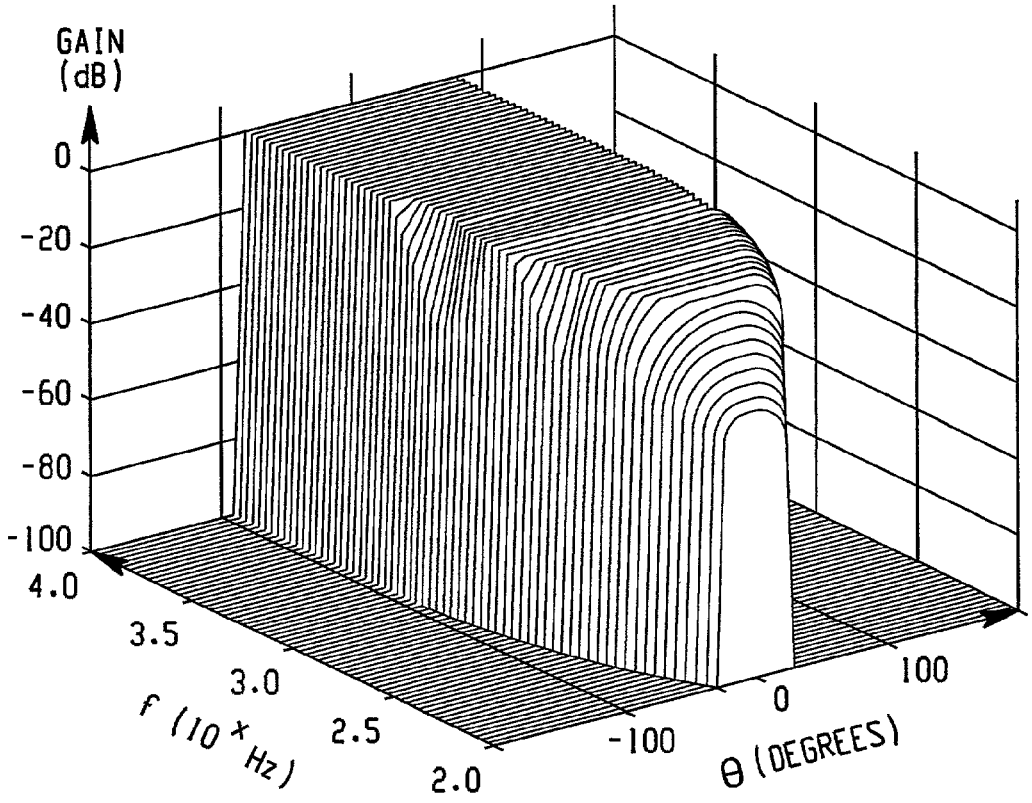

Further reducing of the preselected range for spatial angle $\theta_R$ leads to the gain behavior as shown in FIG. 11.

Figure 1:
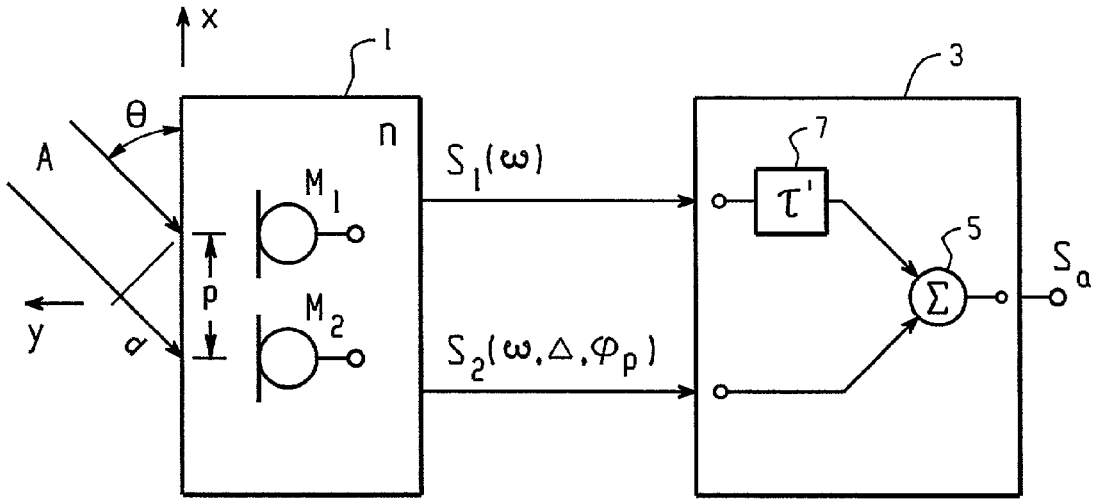
Figure 2:
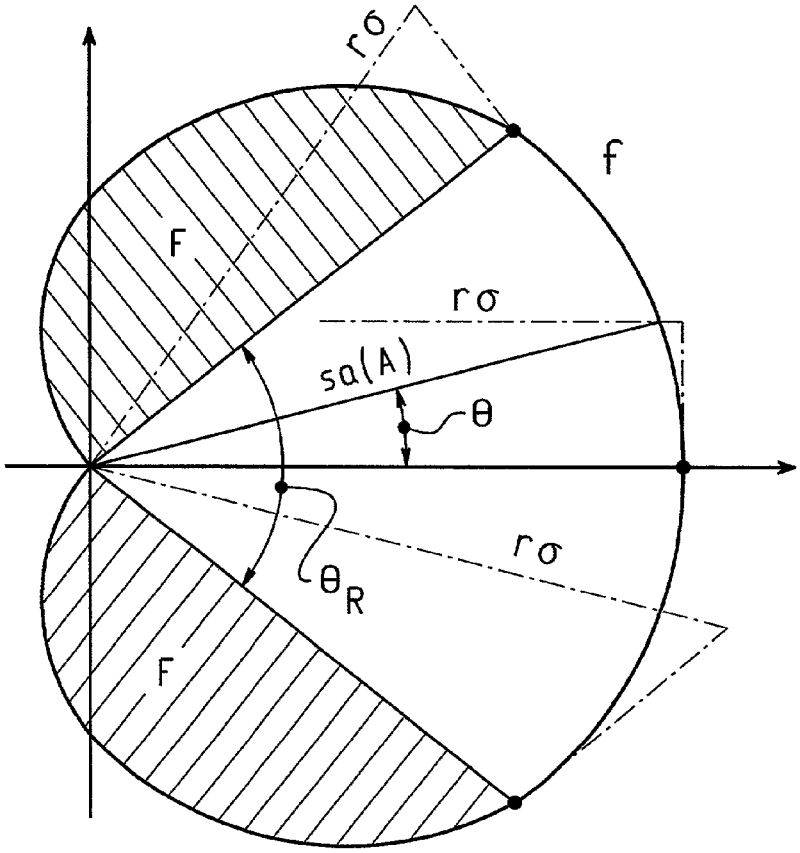
Figure 3:
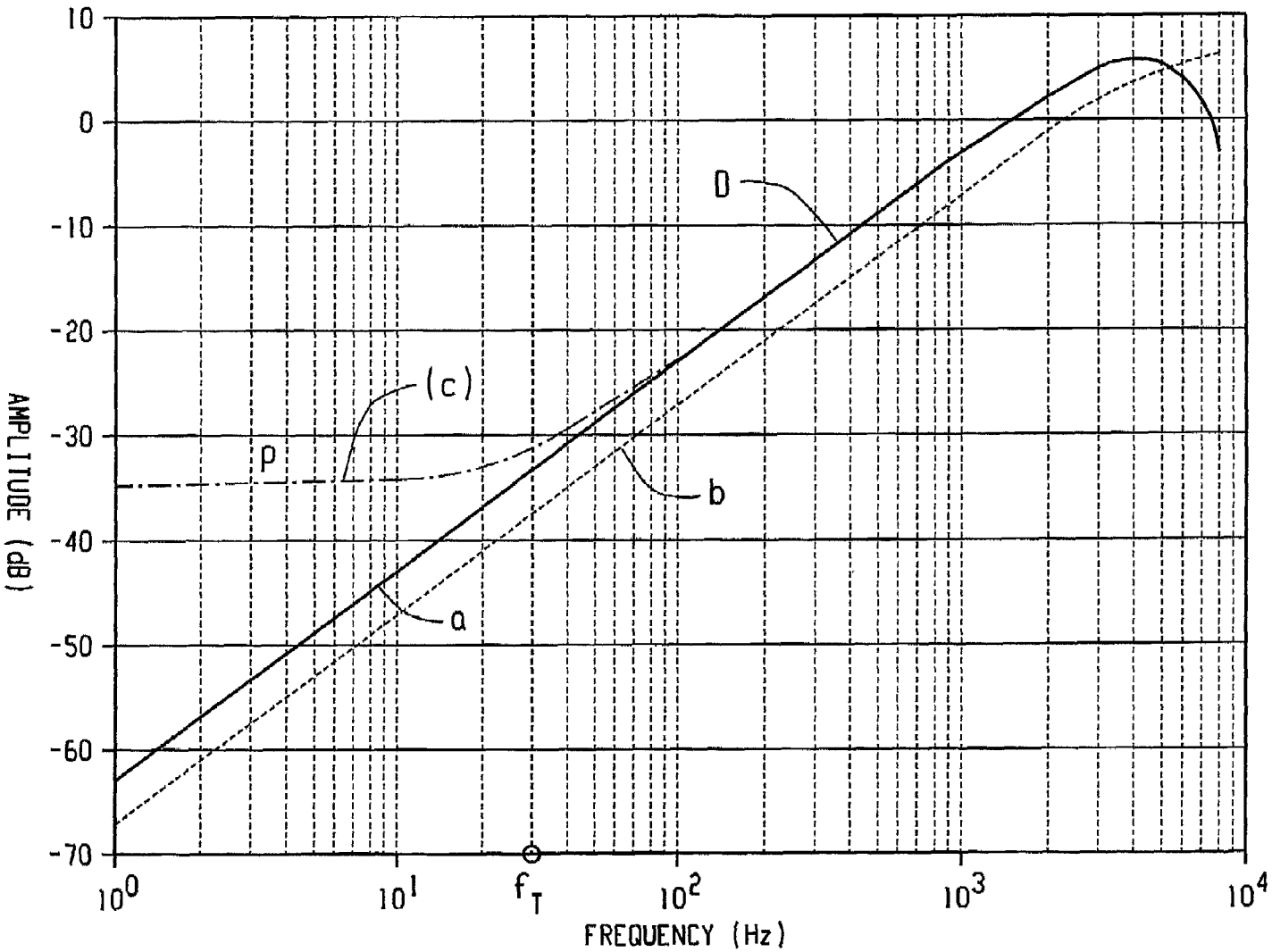
Figure 4:
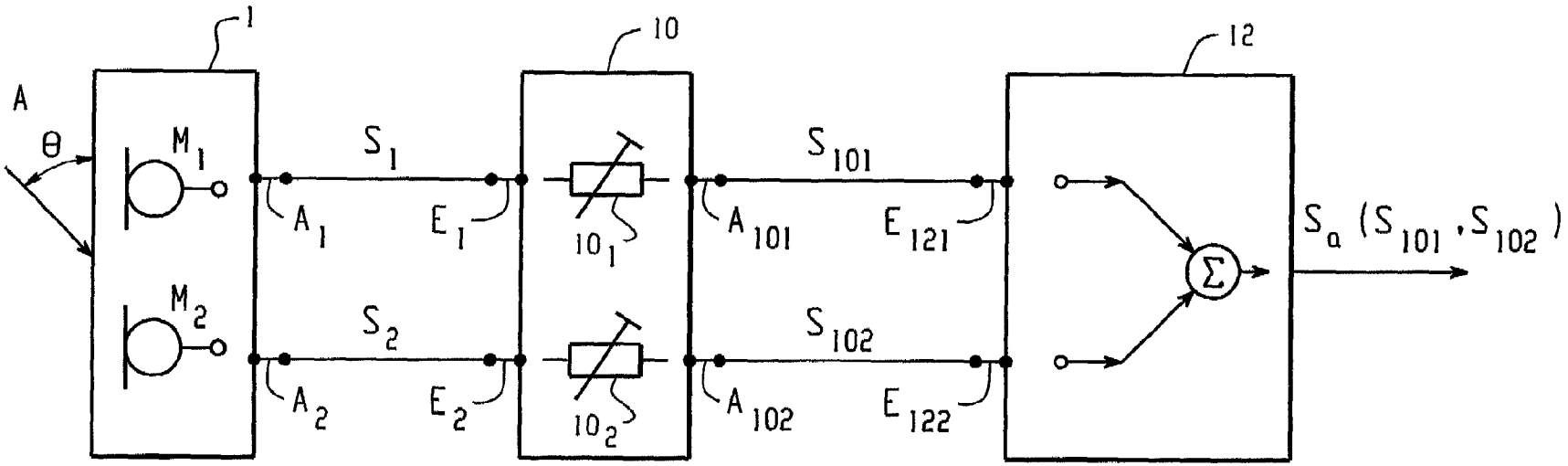
Figure 5:
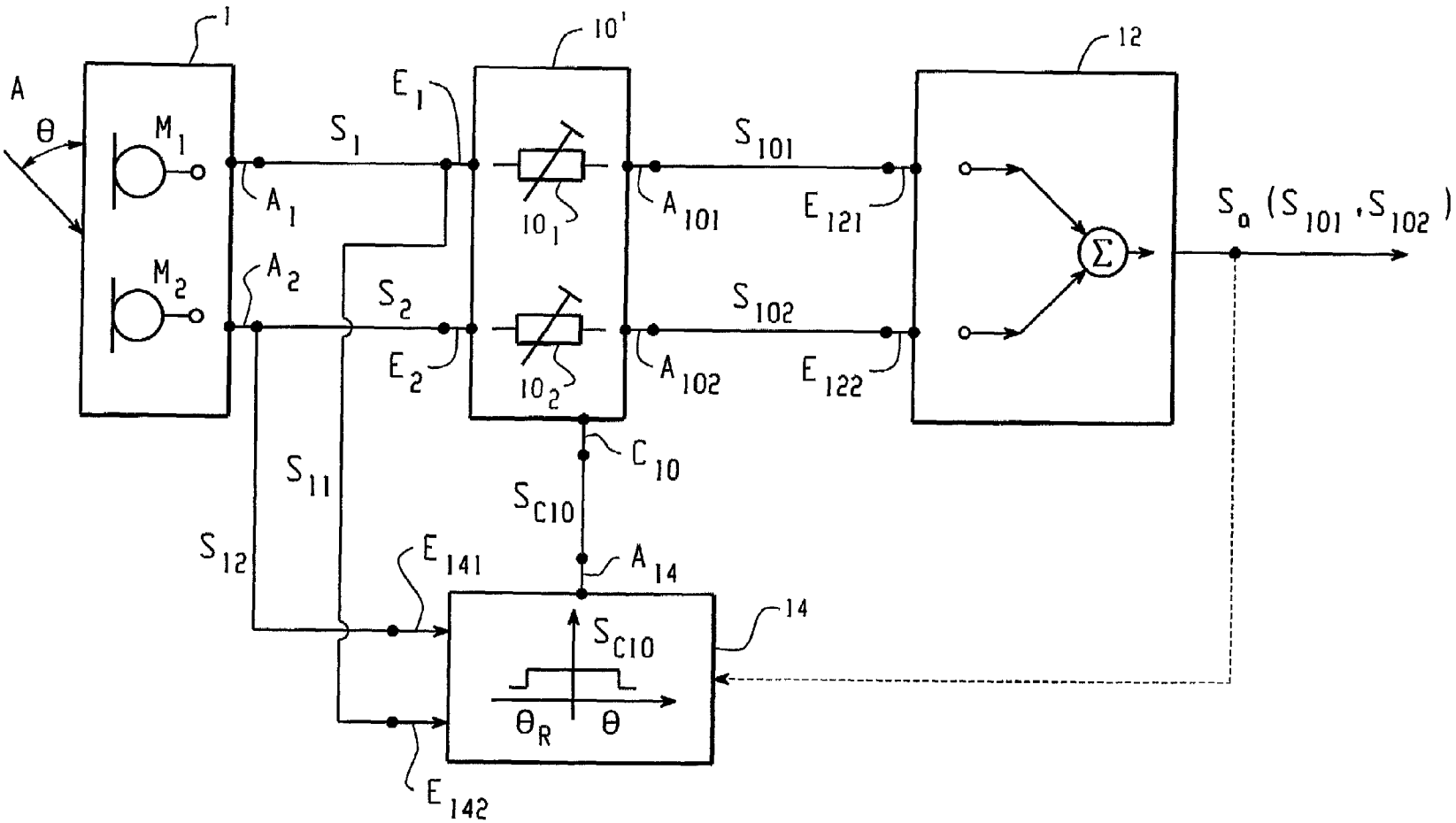
Figure 6:
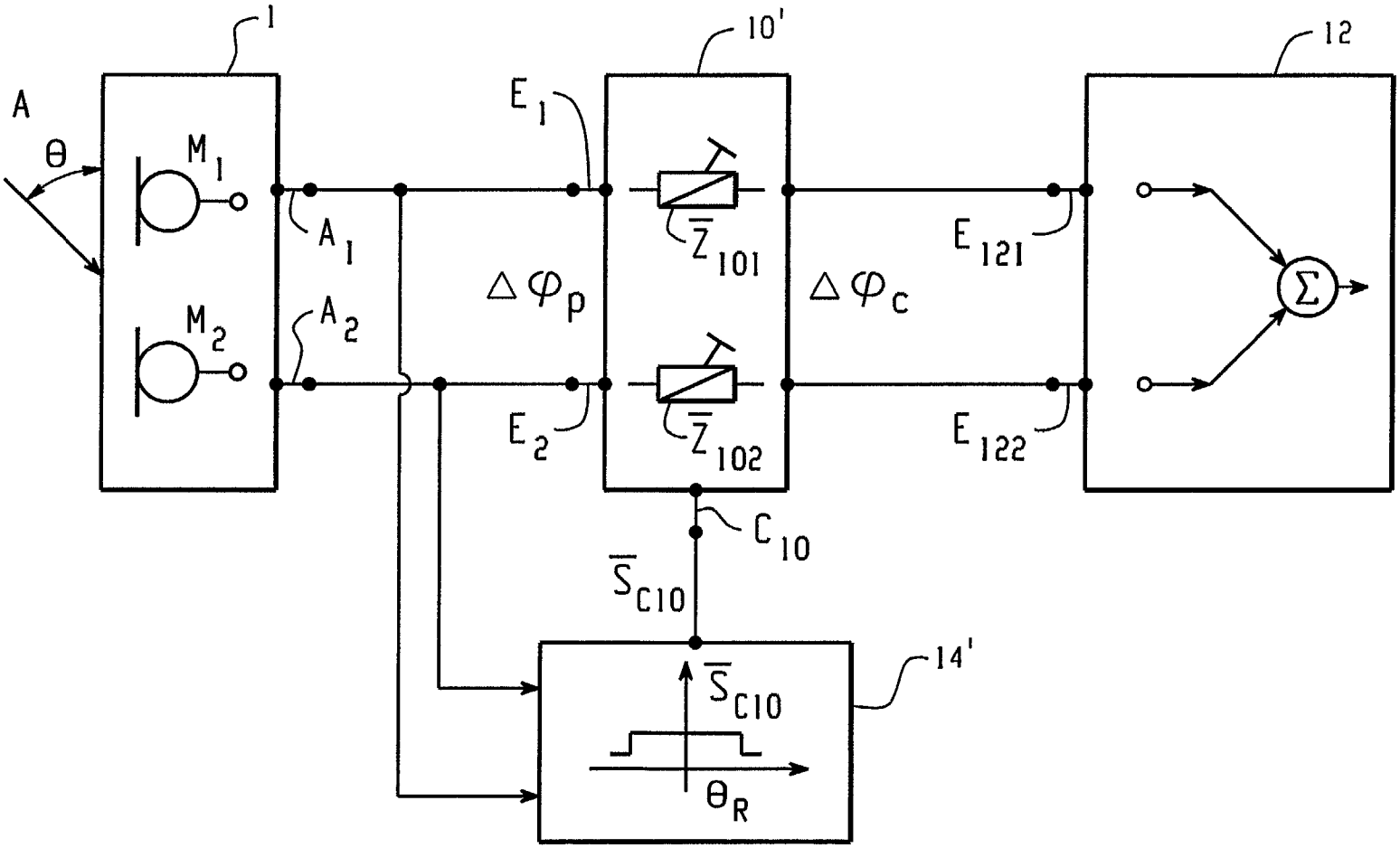
Figure 7:
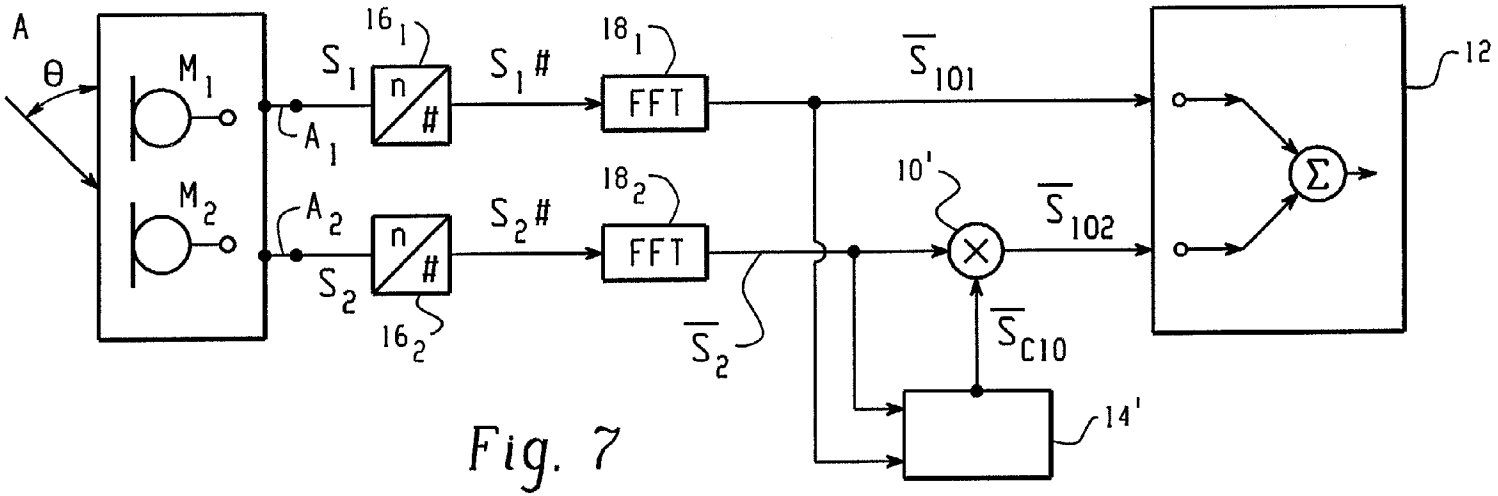
Figure 8:
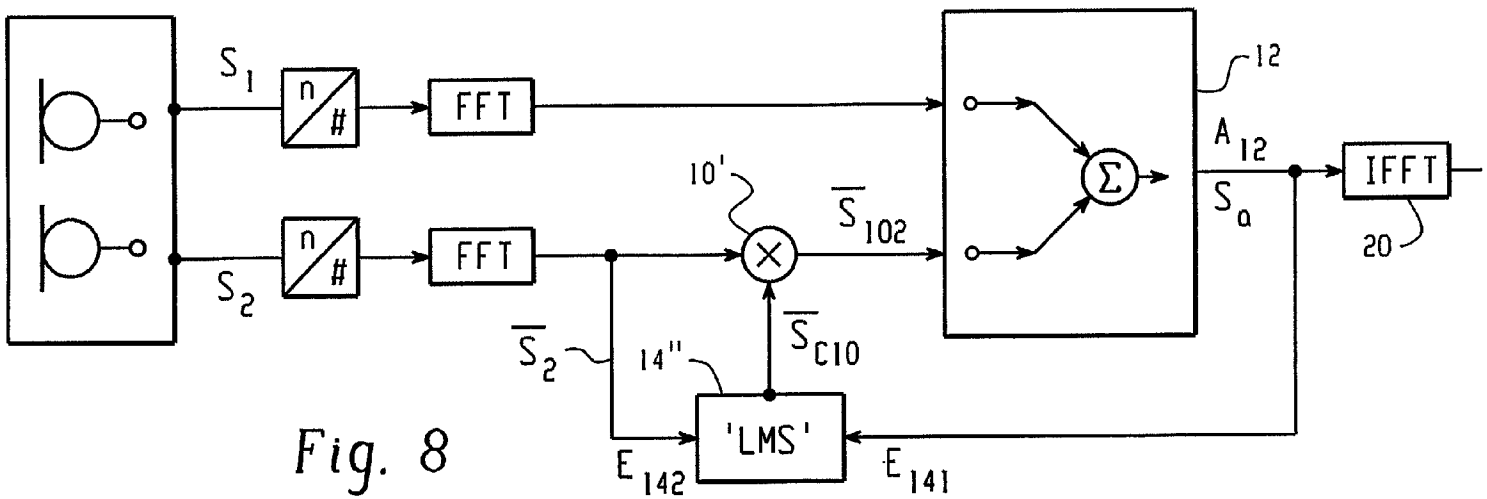
Figure 9:
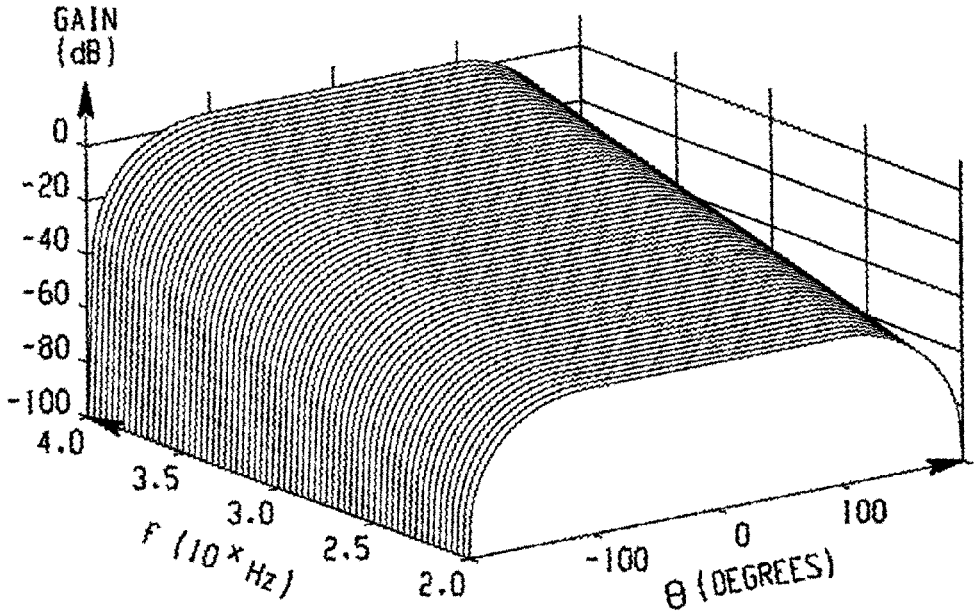
FIG. 9 shows over the axis of spatial angle θ and frequency f the gain magnitude as measured at a prior art "delay and sum" beamformer of first order with cardioid characteristic as of FIG. 2 and with zero gain at an angle θ=180°.
Figure 10:
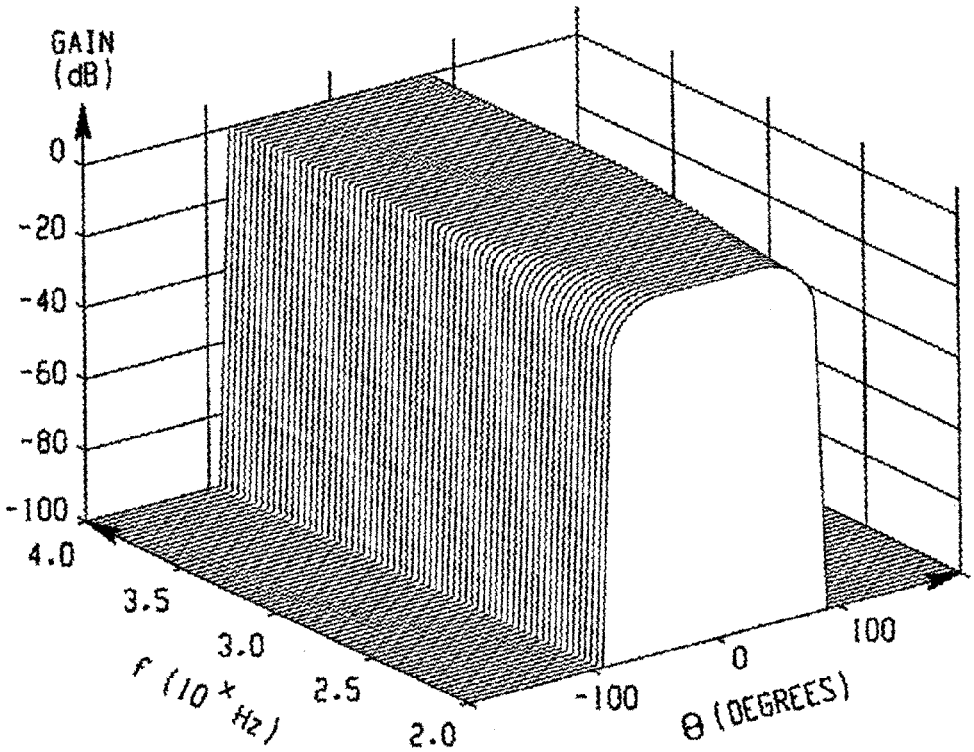
FIG. 10 shows in the same representation as of FIG. 9 the gain characteristic between acoustical input and system output of a beamformer construed as was explained with the help of FIG. 8, thereby selecting the preselected range $\theta_R$ to be at $-90° \leqq \theta \leqq +90°$.

From comparison of the FIGS. 9 to 11 the significant improvements of the transfer characteristic of a conversion system and the method according to the present invention become apparent to the skilled artisan.

The invention claimed is:

1. A method of generating an electrical output signal as a function of acoustical input signals impinging on at least two acoustical/electrical converters, the gain between said acoustical input signals and said electric output signal being dependent on the spatial angle with which said acoustical input signals impinge on said at least two converters and on frequency of said acoustical input signals, and wherein further first and second signals respectively depending on said acoustical input signals are co-processed to result in a third signal which is dependent on both said first and said second signals, characterized by establishing a desired frequency dependency of said gain by installing a mismatch of gain of said acoustical input signal to said first signal and of said acoustical input signal to said second signal.

2. The method of claim 1, wherein said mismatch is installed in a fixed manner or adjustable or automatically adjusted.

3. The method of claim 1 or 2, further comprising establishing said mismatch in dependency of said spatial angle of said acoustical input signals.

4. The method of claim 3, further comprising establishing said mismatch, whenever said spatial angle is within a predetermined range.

5. The method of claim 1, further comprising establishing said mismatch in dependency of frequency of said acoustical input signal.

6. The method of claim 1, further comprising time-delaying one of said first and of said second signals before performing said co-processing.

7. The method of claim 6, further comprising performing said time-delaying in dependency of frequency of said acoustical input signals.

8. The method of claim 1, further comprising performing time-domain to frequency-domain conversion of said first and second electrical signals before performing said co-processing.

9. The method of claim 1, further comprising performing tie-domain to frequency-domain conversion of said first and second electrical signals, generating for subsequent time frames of said converting and for at least a part of the frequencies of said conversion a complex mismatch control signal, thereby adjusting mutual phasing of said first and second signals and performing said mismatch by said complex mismatch control signal.

10. The method of claim 9, thereby calculating an actual mismatch control signal by means of an approximation algorithm.

11. The method of claim 10, further comprising calculating said actual mismatch control signal on the basis of said mismatch control signal as derived in a previous time frame.

12. The method of claim 10, further comprising the step of calculating said actual mismatch control signal by means of a "least means square" algorithm.

13. The method of claim 1, wherein said acoustical to electrical converters are microphones of a hearing aid apparatus.

14. An acoustical/electrical conversion system comprising at least two acoustical to electrical converters, respectively with a first and a second output, said outputs being operationally connected to inputs of a co-processing unit generating an output signal dependent on signals on both said first and said second outputs, the output of said co-processing unit being operationally connected to an output of said system, whereat a signal is generated, which is dependent on an acoustical signal impinging on said at least two converters and from spatial angle with which said acoustical signal impinges on said at least two converters as well as on frequency of said acoustical signal, characterized by the gains between acoustical inputs to said converters and said inputs of said co-processing unit being mismatched to provide for a desired dependency of said signal generated at said output of said system from said frequency.

15. The system of claim 14, wherein said mismatch is established by means of a mismatch unit interconnected between at least one of said first and second outputs and said inputs of said co-processing unit.

16. The system of claim 15, said mismatch unit comprising a mismatch control input operationally connected to an output of a mismatch control unit, inputs of said mismatch control unit being operationally connected to said first and second outputs, said mismatch control unit generating a mismatch control signal in dependency of said spatial angle.

17. The system of claim 16, wherein said mismatch control unit generates a mismatch control signal, whenever said spatial angle is within a pre-selectable or pre-selected angular range.

18. The system of one of claims 15 to 17, further comprising said mismatch unit providing for gain mismatch a and phase adjustment.

19. The system of one of claims 15 to 17, further comprising time-domain to frequency-domain conversion units interconnected between said outputs of said at least two converters and said co-processing unit, said mismatch unit being provided between an output of at least one of said time-domain to frequency-domain conversion units and at least one input of said co-processing unit.

20. The system of claim 19, said, mismatch unit having a control input operationally connected to an output of a mismatch control unit, said mismatch control unit having inputs operationally connected to said first and second output signals and generating a complex mismatch controlling signal controlling at said mismatch unit phasing of signals input to said inputs of said co-processing unit as well as said gain mismatch.

21. The system of claim 20, wherein said mismatch control has one of said inputs being operationally connected to the output of said system, said mismatch control unit comprising an approximation calculating unit.

22. The system of claim 21, wherein said approximation calculating unit is a "least means square" calculating unit.

23. The system of claim 14, wherein said acoustical to electrical converters are integrated in a hearing apparatus.

24. The system of claim 23, wherein said apparatus is a hearing aid apparatus.

* * * * *